United States Patent [19]

Kanematsu et al.

[11] Patent Number: 4,812,703

[45] Date of Patent: Mar. 14, 1989

[54] ELECTRIC LAMP ASSEMBLY

[75] Inventors: Susumu Kanematsu; Kenji Ishii, both of Kitawaki, Japan

[73] Assignee: Koito Seisakusho Co., Ltd., Tokyo, Japan

[21] Appl. No.: 943,431

[22] Filed: Dec. 19, 1986

[30] Foreign Application Priority Data

| | | | |
|---|---|---|---|
| Dec. 19, 1985 | [JP] | Japan | 60-286707 |
| Dec. 19, 1985 | [JP] | Japan | 60-286708 |
| Dec. 19, 1985 | [JP] | Japan | 60-286709 |
| May 23, 1986 | [JP] | Japan | 61-118868 |
| Aug. 8, 1986 | [JP] | Japan | 61-186577 |
| Sep. 26, 1986 | [JP] | Japan | 61-227842 |

[51] Int. Cl.[4] ..... H01J 5/48

[52] U.S. Cl. ..... 313/318; 313/315; 362/362

[58] Field of Search ..... 313/318, 113, 315; 362/267, 310, 362, 296; 439/612, 613, 617, 816, 851

[56] References Cited

U.S. PATENT DOCUMENTS

| | | | |
|---|---|---|---|
| 3,960,278 | 6/1976 | Vause | 313/318 |
| 4,609,977 | 9/1986 | Eckhardt et al. | 362/267 |
| 4,631,651 | 12/1986 | Bergin et al. | 362/267 |
| 4,687,965 | 8/1987 | Sanders et al. | 313/318 |

*Primary Examiner*—Leo H. Boudreau
*Assistant Examiner*—T. Salindong
*Attorney, Agent, or Firm*—Browdy & Neimark

[57] ABSTRACT

An electric lamp assembly which includes a bulb unit having a rectangularly shaped hermetic seal portion through which lead wires from a filament extend to the outside of the bulb unit, a bulb holder having a rectangularly looped band portion which grips the hermetic seal portion of the bulb unit with the lead wires projected outwardly from the bulb holder, a base assembly of moulded plastics supporting tightly the bulb holder and terminal members held by the base assembly and having inward ends projected toward the lead wires and welded to the same. The base assembly includes a hollow base structure and a rounded core structure which is coupled and welded to each other.

32 Claims, 19 Drawing Sheets

10B
400B
414a
408
416
416a
412
410
404
406
414a
414
422a
422
420
408a
418
418a
500
302a
306
302
308
300B
304
312
314
312
310
312
304a
302b
302c
200B
202
206b
110a
204b
204
204a
206
202a
204a
204b
204
204b
204
104
100
110
102
106
108
110a

ELECTRIC LAMP ASSEMBLY

BACKGROUND OF THE INVENTION

1. Field of the Invention

The present invention relates in general to electric lamp assemblies and more particularly to electric lamp assemblies of a type which comprises a bulb unit and a base structure of moulded plastics.

2. Description of the Prior Art

Prior to describing in detail the present invention, one of the conventional electric lamp assemblies will be outlined with reference to FIG. 35 in order to clarify the task of the invention.

Referring to FIG. 35, there is shown a conventional electric lamp assembly "a" which is disclosed in U.S. Pat. No. 4,412,273. The electric lamp assembly "a" comprises a rounded base structure "b" of moulded plastics having a smaller diameter rear portion from which terminals "c" are projected outward. A metal sleeve "d" is coaxially disposed on and secured to a front portion of the base structure "b". The metal sleeve "d" is formed at its leading end with small spaced lugs "e" which are welded to cylindrical outer surface of a circular metal cap "f". The metal cap "f" is snugly disposed at its rear end in the mouth portion of the metal sleeve "d" and supports thereon a bulb "g". The bulb "g" has therein a filament "h" from which lead wires (not shown) extend to the outside of the bulb "g". Although not shown in the drawing, the lead wires are welded to inward projected ends of the terminals "c" within the metal sleeve "d".

However, due to its inherent construction, the electric lamp assembly "a" has the following drawbacks.

First, it is troublesome to properly connect the lead wires to the terminals "c" in the metal sleeve "d". That is, during assembly, the lead wires from the bulb "g" are welded to the inward projected ends of the terminals "c" held by the base structure "b", and the metal sleeve "d" is put on the front portion of the base structure "g" having the bulb "b" and the metal cap "f" passed therethrough, and the metal sleeve "d" is secured to the base structure "b" and then, the metal cap "f" is turned about its axis to a given angular position relative to the base structure "b" and thereafter, the small lugs "e" of the metal sleeve "d" are welded to the metal cap "f". However, this assembling procedure tends to induce an undesirable short circuit of the lead wires with the metal sleeve "d" particularly when the lead wires have remained relatively long within length in the metal sleeve "d". In fact, by the presence of the metal sleeve "d", the condition of the connections of the lead wires can not be viewed from the outside of the assembly "a".

Second, it is difficult to properly set the angular position of the bulb "g", viz., the filament "h" of the same relative position to the base structure "b". Because of absence of any positioning means between the metal sleeve "d" and the metal cap "f", the angular positioning of the bulb "g" must be made roughly depending on the assembling techniques individually possessed by assemblers.

SUMMARY OF THE INVENTION

It is therefore an essential object of the present invention to provide an improved electric lamp assembly which is free of the above-mentioned drawbacks.

It is an object of the present invention to provide an electric lamp assembly which is constructed to faciliate connection between the lead wires from the bulb and the terminals from the base structure.

It is another object of the present invention to provide an electric lamp assembly which is constructed to facilitate angular positioning of the bulb relative to the base structure.

It is still another object of the present invention to provide an electric lamp assembly having a hollow light-weight base structure constructed of moulded plastics.

According to the present invention, there is provided an electric lamp assembly which comprises a bulb unit including a filament, lead wires extending from the filament to the outside of the bulb unit and a rectangularly shaped hermetic seal portion, the lead wires extending through the hermetic seal portion, a bulb holder including a rectangularly looped band portion which grips the hermetic seal portion of the bulb unit having leading ends of the lead wires projected outwardly from the bulb holder, a base assembly of moulded plastics tightly supporting the bulb holder, and terminal members tightly held by the base assembly and having inward ends projected toward the leading ends of the lead wires and welded to the same.

According to the present invention, there is also provided an electric lamp assembly which comprises a bulb holder including a bulb, a rounded core structure of moulded plastics which supports the bulb assembly, a base structure of moulded plastics, the base structure having a cylindrical bore which is sized to snugly receive therein the core structure, positioning means for positioning the core structure relative to the cylindrical bore of the base structure, and securing means for securing the core structure to the base structure when the core structure is properly positioned in the bore of the base structure.

According to the present invention, there is further provided an electric lamp assembly which comprises a bulb unit with a filament, a bulb holder tightly holding the bulb unit, a core structure of moulded plastics having supporing pins which are connected to the bulb holder in a manner so as to adjust the distance between the filament of the bulb unit and a given portion of the core structure, a base structure of moulded plastics constructed essentially hollow and having an entrance in which said core structure is tightly received for connection with the base structure, and elongate conducting members passing through the hollow of the base structure, each having one end connected to a lead wire of the filament of the bulb unit and the other end placed in a portion of the hollow.

BRIEF DESCRIPTION OF THE DRAWINGS

Other objects and advantages of the present invention will become apparent from the following description when taken in conjunction with the accompanying drawings, in which:

FIGS. 1 to 7 are drawings showing an electric lamp assembly of a first embodiment of the present invention, in which:

FIG. 1 is an exploded view of the electric lamp assembly;

FIG. 2 is a perspective view of the electric lamp assembly in assembled condition;

FIG. 3 is a vertically sectional view of the electric lamp assembly;

FIG. 4 is a front view of a base structure employed in the electric lamp assembly;

FIG. 5 is a back view of the base structure of the electric lamp assembly:

FIG. 6 is a view taken from the direction of the arrow "VI" of FIG. 4;

FIG. 7 is a partially cut perspective view of a core structure of the electric lamp assembly; and FIGS. 8 to 16(B) are drawings showing an electric lamp assembly of a second embodiment of the present invention, in which:

FIG. 8 is an exploded view of the electric lamp assembly;

FIG. 9 is a perspective view of the electric lamp assembly in assembled condition;

FIG. 10 is a vertically sectional view of the electric lamp assembly;

FIG. 11 is an enlarged perspective view of a bulb holder employed in the electric lamp assembly;

FIG. 12 is a front view of a base structure employed in the electric lamp assembly;

FIG. 13 is a back view of the base structure of the electric lamp assembly;

FIG. 14 is a view taken from the direction of the arrow "XIV" of FIG. 12;

FIG. 15 is a partially cut perspective view of a core structure employed in the electric lamp assembly;

FIG. 16(B) is a view similar to FIG. 16(A ), but showing the base structure and the core structure in coupled condition; and FIGS. 17 to 20 are drawings showing an electric lamp assembly of a third embodiment of the present invention, in which:

FIG. 17 is an exploded view of an electric lamp assembly of a third embodiment of the present invention;

FIG. 18 is a perspective view of the electric lamp assembly in assembled condition;

FIG. 19 is a sectional view taken along the line XIX—XIX of FIG. 18;

FIG. 20 is a perspective view showing a bulb unit and a bulb holder in uncoupled condition; and FIGS. 21 to 23 are drawings showing an electric lamp assembly of a fourth embodiment of the present invention, in which:

FIG. 21 is a perspective view of the electric lamp assembly in assembled condition;

FIG. 22 is a sectional view taken along the line XXII—XXII of FIG. 21;

FIG. 23 is a perspective view showing a bulb unit and a bulb holder in uncoupled condition; and FIGS. 24 to 26 are drawings showing an electric lamp assembly of a fifth embodiment of the present invention, in which:

FIG. 24 is a perspective view of the electric lamp assembly;

FIG. 25 is a vertically sectional view of the electric lamp assembly;

FIG. 26 is an exploded view of the electric lamp assembly; and

FIGS. 27 to 30 are drawings showing an electric lamp assembly of a sixth embodiment of the present invention, in which:

FIG. 27 is a perspective view of the electric lamp assembly in assembled condition;

FIG. 28 is an exploded view of the electric lamp assembly;

FIG. 29 is a vertically sectional view of the electric lamp assembly;

FIG. 30 is a side view of the electric lamp assembly; and

FIGS. 31 to 36 are drawings showing an electric lamp assembly of a seventh embodiment of the present invention, in which:

FIG. 31 is a perspective view of the electric lamp assembly in assembled condition;

FIG. 32 is a partially cut side view of the electric lamp assembly;

FIG. 33 is a side view of the electric lamp assembly taken from another direction;

FIG. 34 is a front view of a base structure employed in the electric lamp assembly; and FIG. 35 is a sectional view of a conventional electric lamp assembly, which has been described hereinabove.

DETAILED DESCRIPTION OF THE INVENTION

In the following description seven embodiments of the present invention will be described in detail with reference to the drawings. In the description and drawings, like parts and constructions are designated by the same numerals and repeated explanation of them is omitted from the description.

Figure 1:
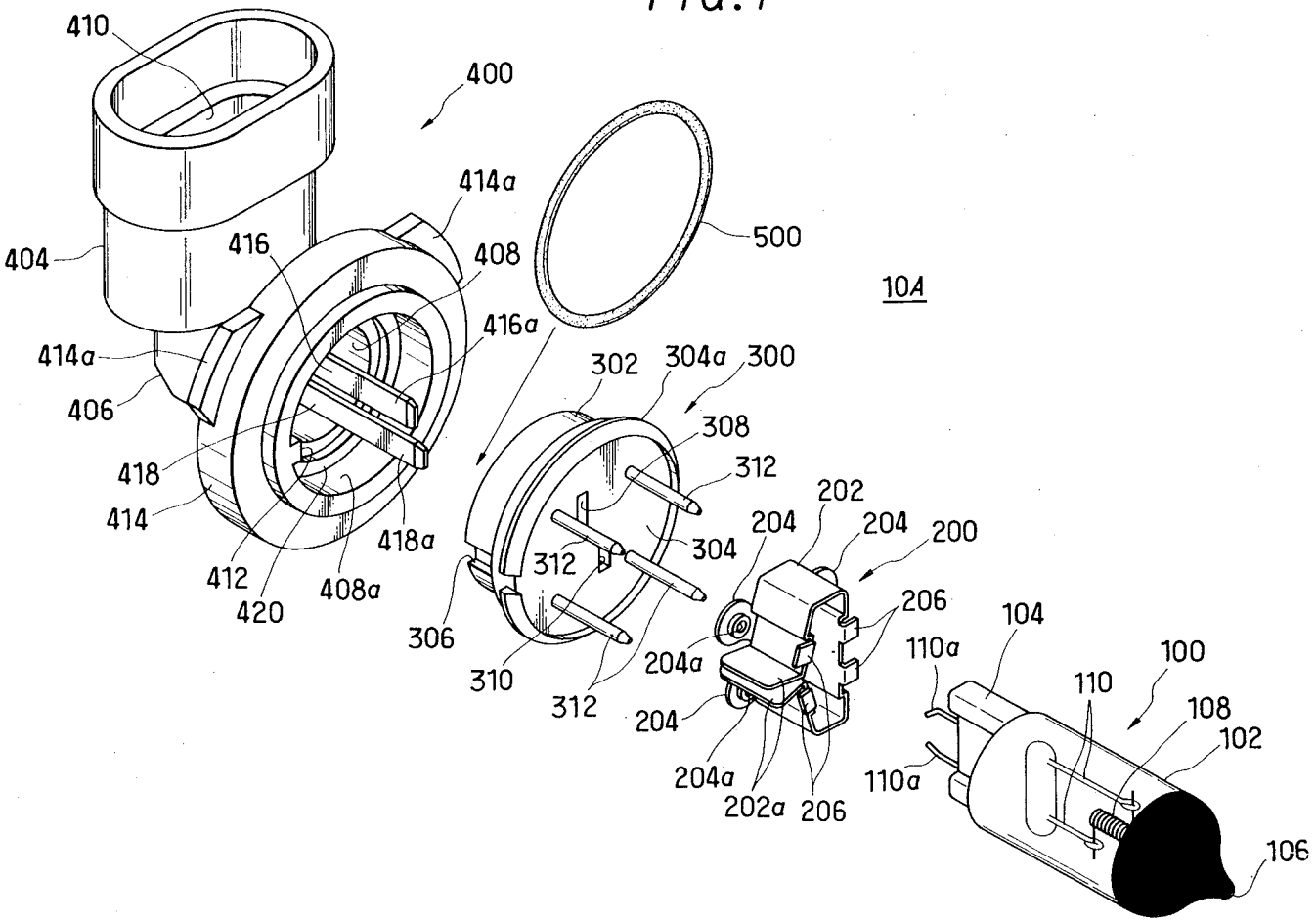
Figure 2:
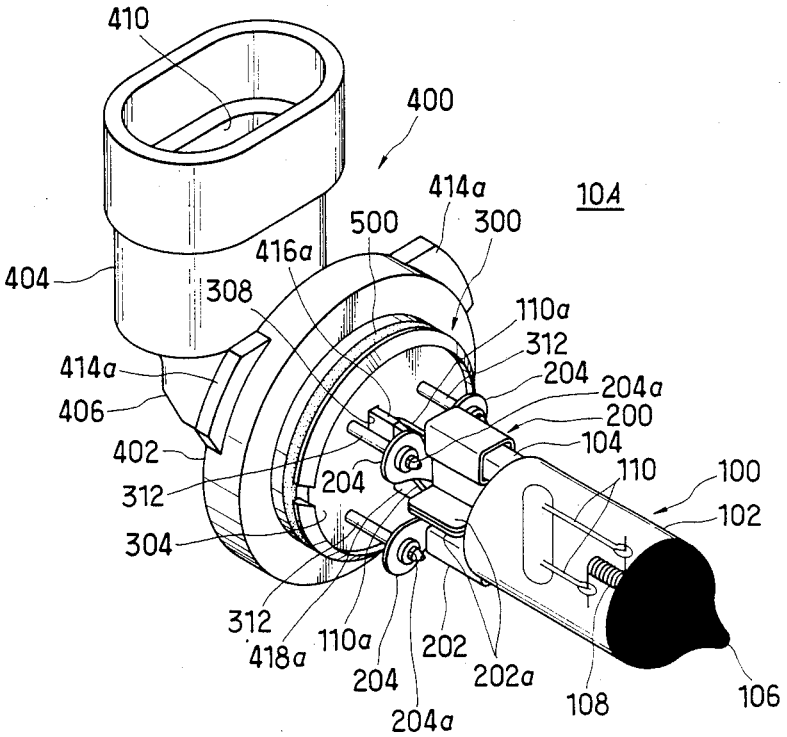
Figure 3:
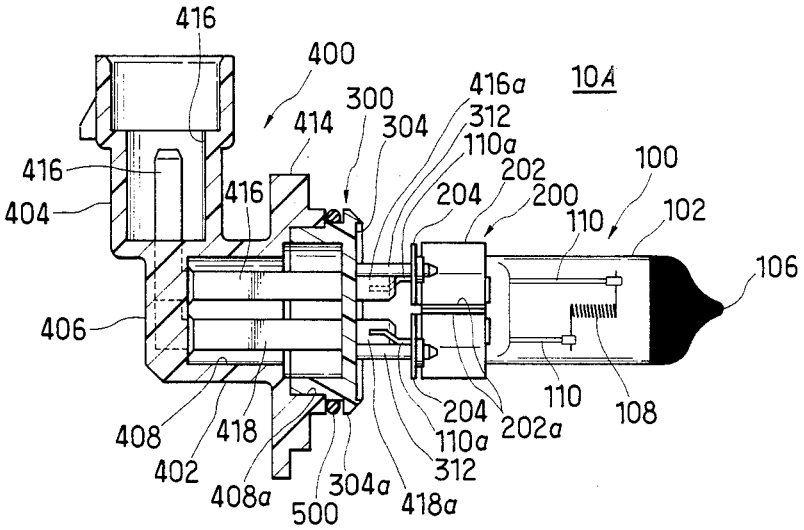
Figure 4:
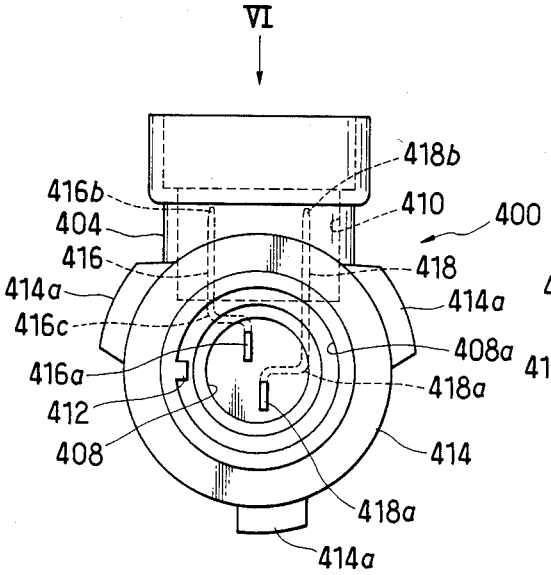
Figure 6:
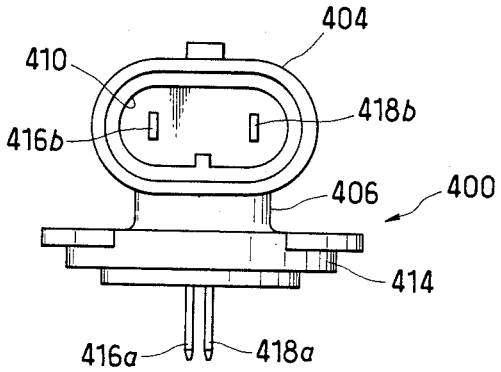
Figure 5:
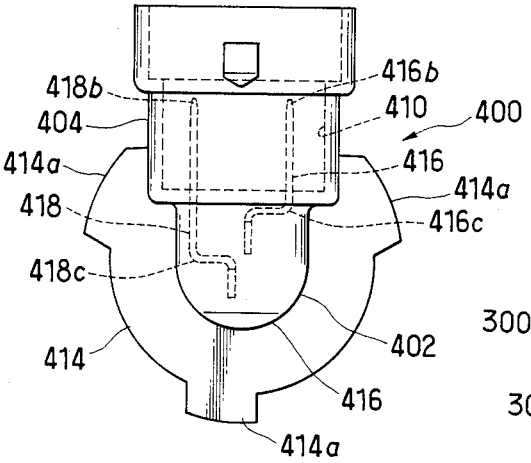
Figure 7:
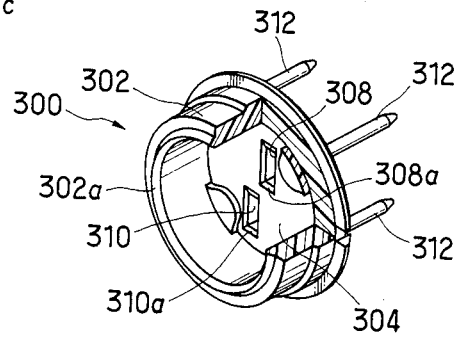

Referring to FIGS. 1 to 7, particularly FIGS. 1, 2 and 3, there is shown an electric lamp assembly 10A of a first embodiment of the present invention.

As is seen from FIG. 1, the electric lamp assembly 10A comprises generally four major parts, viz., a bulb unit 100, a bulb holder 200, a core structure 300 and a base structure 400 which are assembled in a manner as will be described hereinafter. For ease of understanding, these four major parts will be individually described and followed by that of the manner how these four major parts are assembled into the electric lamp assembly 10A.

As is best seen from FIG. 1, the bulb unit 100 comprises a halogen bulb 102 terminating in a hermetic seal 104 at one end and in an exhaust tip 106 at another. The hermetic seal 104 is constructed in rectangular shape as shown. As is known, the halogen bulb 102 contains therein an inert gas and a given amount of halogen. Received in the bulb 102 is a coiled filament 108 which is supported by a pair of lead wires 110. These lead wires 110 are anchored in and extend outwardly from the hermetic seal 104 to provide exterior leads 110*a*.

The bulb holder 200 is entirely constructed of a metal plate, which functions to hold the bulb unit 100 and mount the same to the core structure 300. The bulb holder 200 comprises a rectangularly looped band portion 202, four foot portions 204 radially projected from one end of the band portion 202 and four lug portions 206 radially projected from the other end of the band portion 202. As is seen from the drawings, the four foot portions 204 are equally spaced and have respective openings 204*a* which are defined by small annular rings secured to the foot portions 204. The band portion 202 is sized and constructed to surround or grip the rectangular hermetic seal 104 of the bulb unit 100 and has opposed flat ends 202*a*.

For coupling the bulb holder 200 and the aforementioned bulb unit 100, the band portion 202 of the bulb holder 200 is put about the hermetic seal 104 of the bulb unit 100 having the four lug portions 206 thereof contacted with the bottom of the halogen bulb 102 and then the opposed flat ends 202*a* of the bulb holder 200 are welded to each other. With this, a bulb assembly (100+200) is provided.

The core structure 300 is a member which is put in the base structure 400 as will be described hereinafter. The core structure 300 comprises a collar portion 302 and a circular plate portion 304 which are of a monoblock construction of thermoplastic resin and coaxially arranged with each other. The collar portion 302 is formed at its outer cylindrical surface with an axially extending groove 306, and the circular plate portion 304 has a diameter somewhat greater than the outer diameter of the collar portion 302 thereby to form thereon an annular ridge 304*a*, as is best seen from FIG. 3. The circular plate portion 304 is formed at its central area with two rectangular slits 308 and 310. As is seen from FIG. 7, the inward end 308*a* or 310*a* of each slit 308 or 310 is somewhat enlarged or chamferred for facilitating insertion of an after-mentioned conducting plate 416 or 418 of the base structure 400 thereinto. As is seen from the same drawing, the collar portion 302 is formed at its leading edge with a coaxial ridge 302*a* which is melted upon coupling with the base structure 400. Four supporting pins 312 extend outward from the circular plate portion 304. These pins 312 have been placed in moulds as inserts upon moulding of the core structure 300. These pins 312 are sized and arranged to mate with the afore-mentioned openings 204*a* of the foot portions 204 of the bulb holder 200, respectively. The leading end of each supporting pin 312 is tapered for facilitating insertion thereof into the opening 204*a* of the corresponding foot portion 204 of the bulb holder 200.

Designated by numeral 500 is a seal ring which is disposed about the ring portion 302 of the core structure 300 as will be understood from FIG. 3.

The base structure 400 is of a monoblock member constructed of moulded plastics, comprising a hollow main portion 402 and a hollow sub portion 404 which are connected at generally right angles with the interposition of a solid joint portion 406 therebetween. In the disclosed embodiment, the hollow main portion 404 has an oval cross section. The hollows of the main and sub portions 402 and 404 are designated by numerals 408 and 410 respectively. As is best seen from FIG. 1, the hollow 408 of the hollow main portion 402 has an enlarged entrance 408*a* which is sized to snugly receive therein the collar portion 302 of the afore-mentioned core structure 300. An axially extending key projection 412 is formed on the inner cylindrical surface of the enlarged entrance 408*a*, which is sized to be snugly received in the groove 306 of the core structure 300. As will become apparent hereinafter, the key projection 412 serves as a positioning means upon coupling of the core structure 300 with the base structure 400. The hollow main portion 402 has at its front portion an annular flange portion 414 which is integrally formed with three spaced projections 414*a* (see FIG. 4). As is seen from FIGS. 1 and 3, two generally L-shaped conducting plates 416 and 418 are stationarily disposed in the base structure 400. As is best seen from FIG. 4, each conducting plate 416 or 418 is anchored in the solid joint portion 406 having the opposed portions 416*a* and 416*b* (or, 418*a* and 418*b*) thereof extending through the hollows 408 and 410, respectively. For ease of understanding, portions of the conducting plates 416 and 418 which are located in the hollow main portion 402 will be referred to as horizontal plate portions 416*a* and 418*a*, while, portions which are located in the hollow sub portion 404 will be referred to as vertical plate portions 416*b* and 418*b*. As is seen from FIG. 4 and 5, the conducting plates 416 and 418 have middle portions 416*c* and 418*c* which are bent away from each other to provide a given longer distance between the two vertical plate portions 416*b* and 418*b* in the hollow sub portion 404 with respect to distance between horizontal plate portions 416*a* and 418*a*. As is seen from FIG. 1, the horizontal plate portions 416*a* and 418*a* are somewhat projected outward from the main portion 402 of the base structure 400. The leading ends of the projected portions are tapered for the purpose which will be apparent hereinafter. Furthermore, the horizontal plate portions 416*a* and 418*a*, more particularly, the outward projected portions of the same are sized and arranged to mate with the afore-mentioned two rectangular slits 308 and 310 of the core structure 300.

For coupling the core structure 300 and the base structure 400 together, the collar portion 302 of the core structure 300 is inserted snugly into the enlarged entrance 408*a* of the hollow main portion 402 so that the groove 306 of the core structure 300 mates with the key projection 412 of the hollow main portion 402 of the base structure 400. During this insertion, the outward projected portions of the horizontal plate portions 416*a* and 418*a* are inserted into and then projected from the rectangular slits 308 and 310 of the core structure 300. Then, a supersonic welding is applied to contact surfaces of the coupled structures 300 and 400 to achieve bonding therebetween. With this, the annular projection or coaxial ridge 302*a* (see FIG. 7) of the collar portion 302 is welded to an annular step portion 420 (see FIG. 1) defined at the bottom of the enlarged entrance 408*a* of the hollow 408 of the main portion 402. A base assembly (300+400) is thus provided.

Then, the afore-mentioned bulb assembly (100+200) and the base assembly (300+400) are coupled. That is, the four supporting pins 312 of the base assembly are inserted into the openings 2O4*a* of the foot portions 204 of the bulb assembly to such an extent that the distance between the annular flange portion 414 of the base structure 400 and the coiled filament 108 of the bulb 102 satisfies a required degree. Then, a suitable welding is applied for securing the foot portions 204 to the pins 312, and then, the exterior leads 110*a* from the bulb 102 are respectively welded to the horizontal plate portions 416*a* and 418*a* which are projected from the core structure 300.

With the above-mentioned assembling steps, the electric lamp assembly 10A as shown in FIG. 2 is provided. Because the horizontal plate portions 416*a* and 418*a* of the conducting plates 416 and 418 are projected outward from the core structure 300, welding of the exterior leads 110*a* to them is easily achieved. Furthermore, the provision of the groove 306 of the core structure 300 and the key ridge 412 of the base structure 400 faciliates the position setting therebetween.

Figure 8:
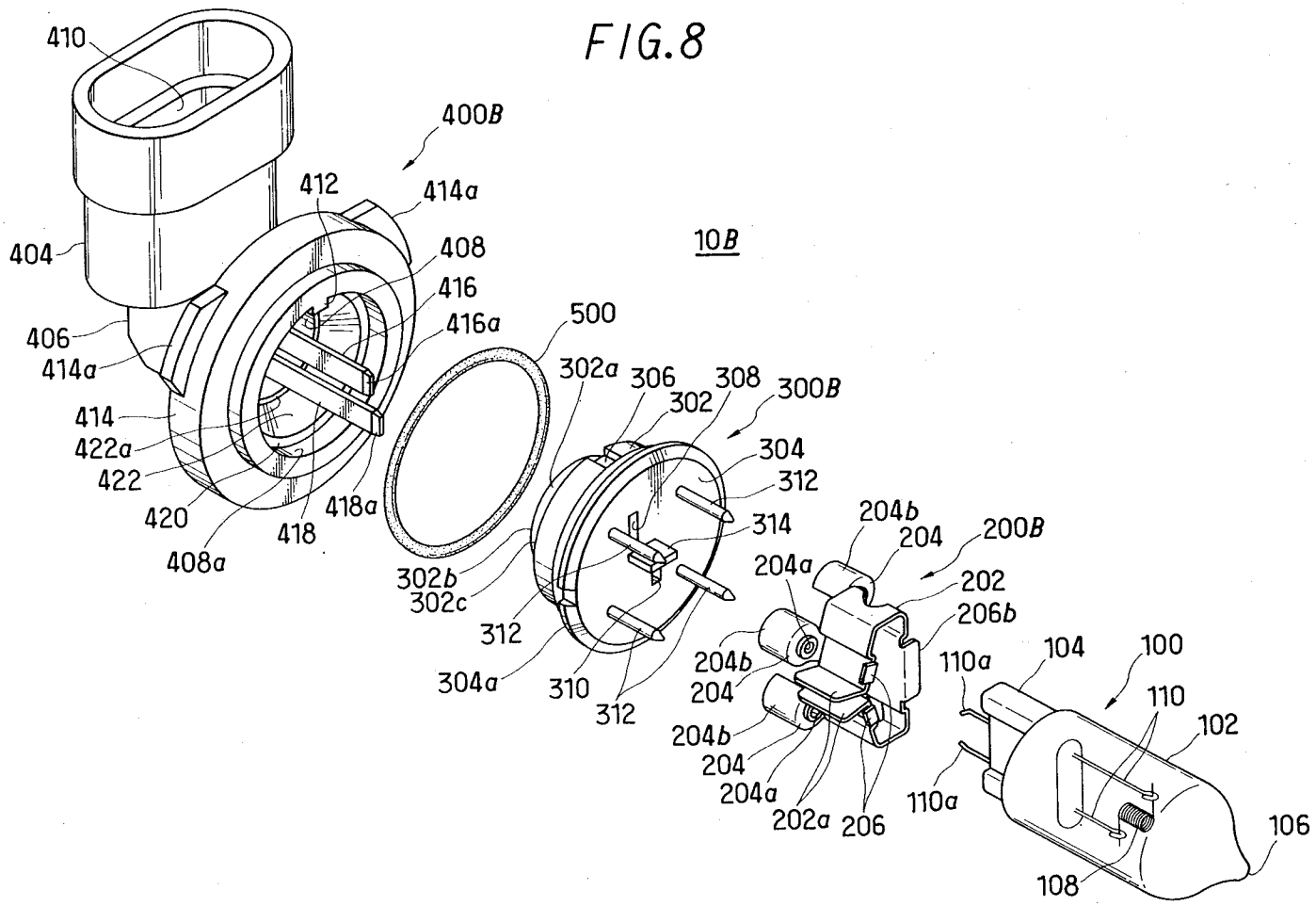
Figure 9:
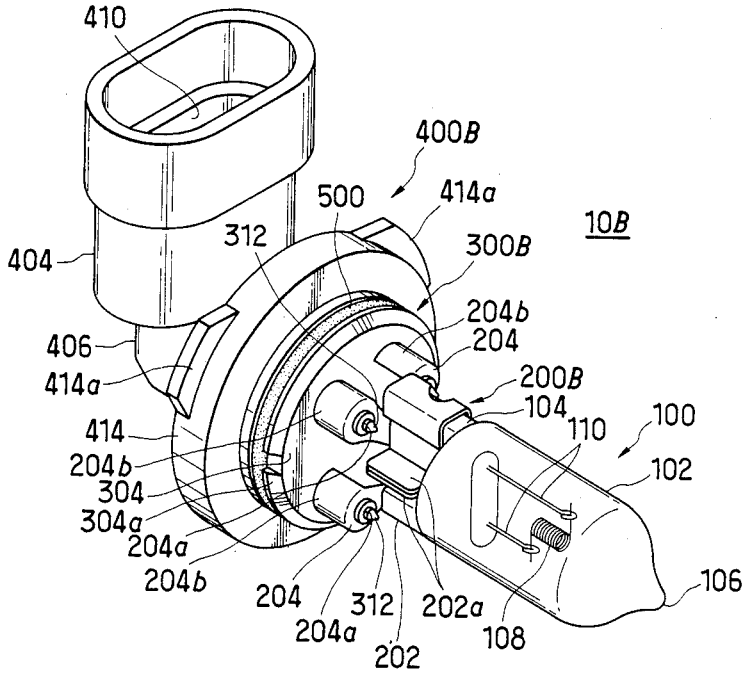
Figure 10:
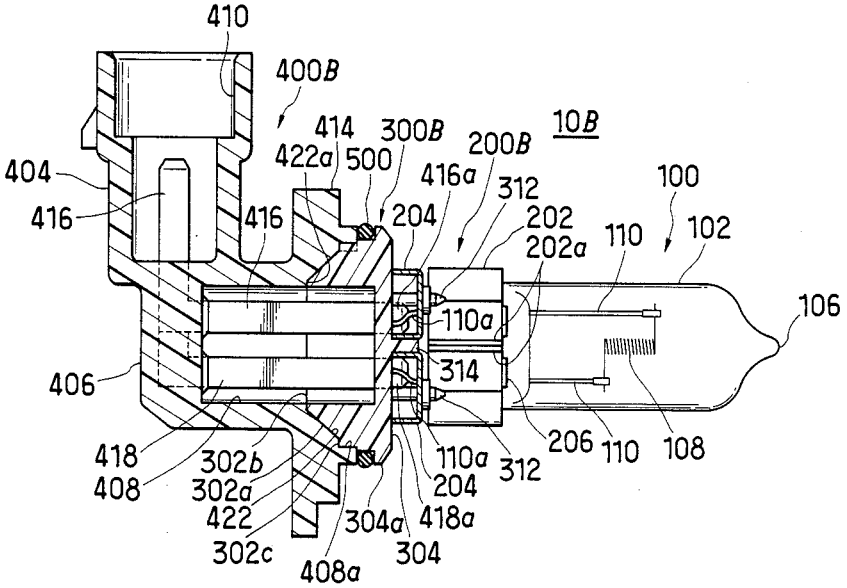
Figure 11:
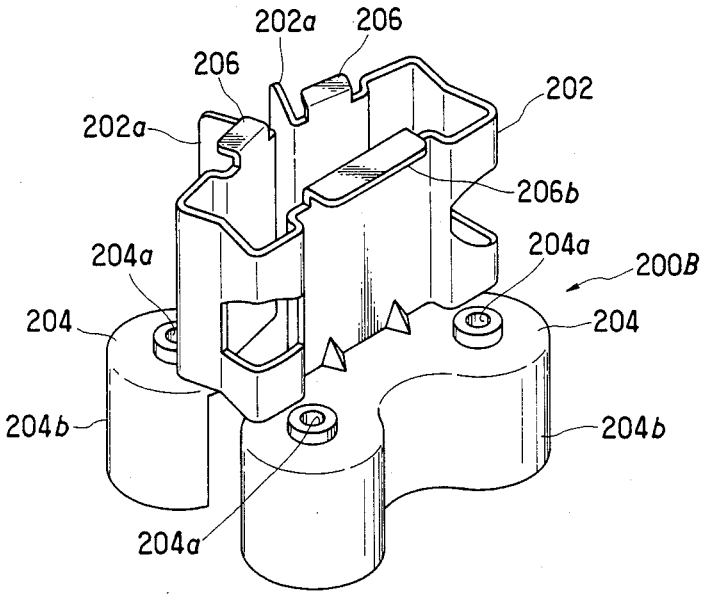
Figure 12:
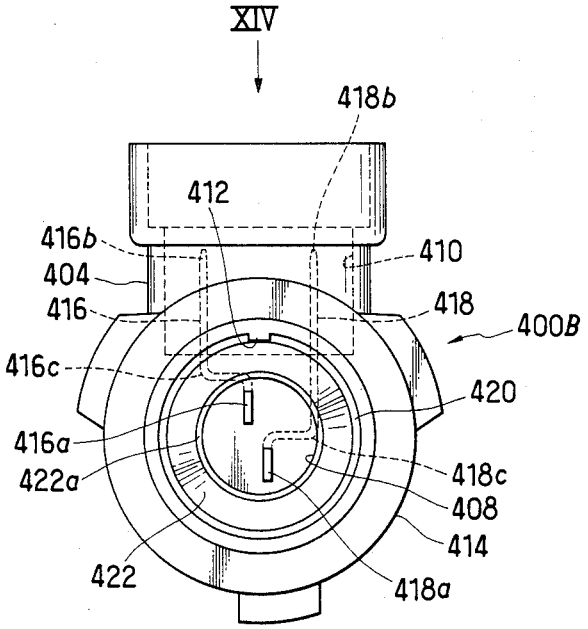
Figure 13:
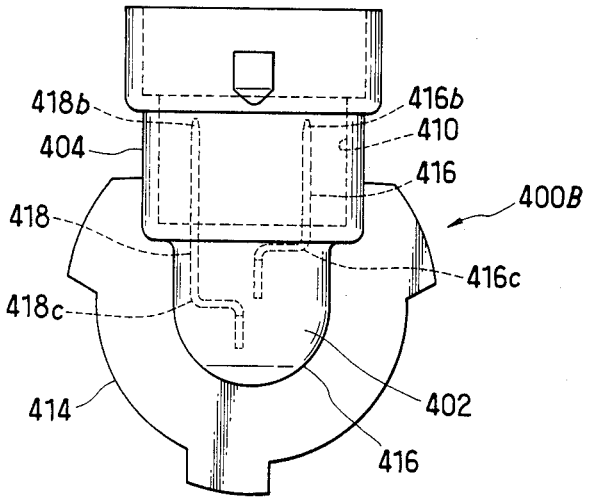
Figure 14:
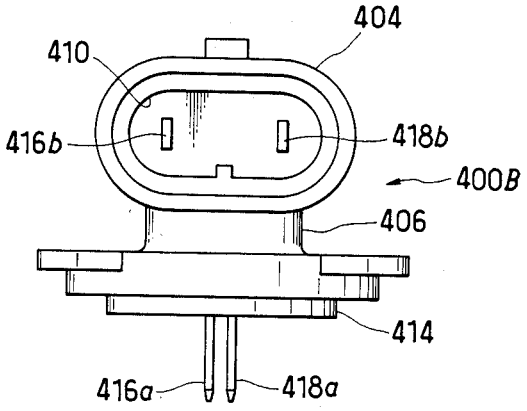
Figure 15:
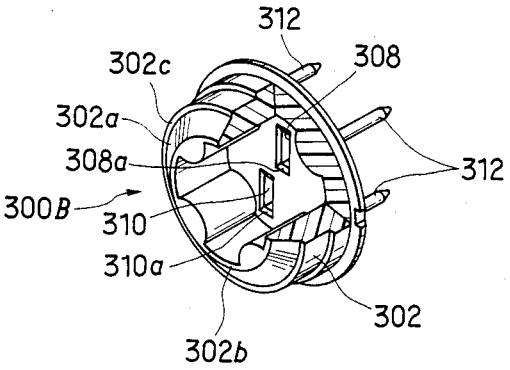
Figure 16A:
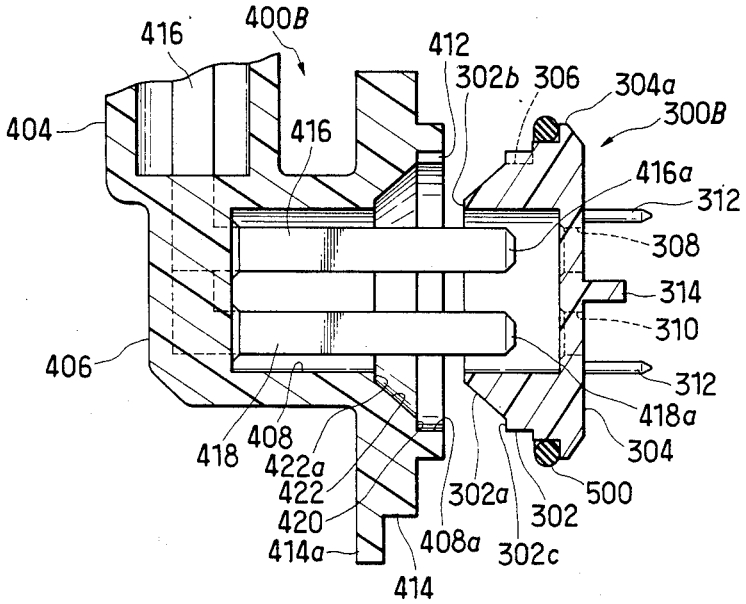
FIG. 16(A) is a sectional view of a part of the electric lamp assembly, showing the base structure and the core structure in uncoupled condition.
Figure 16B:
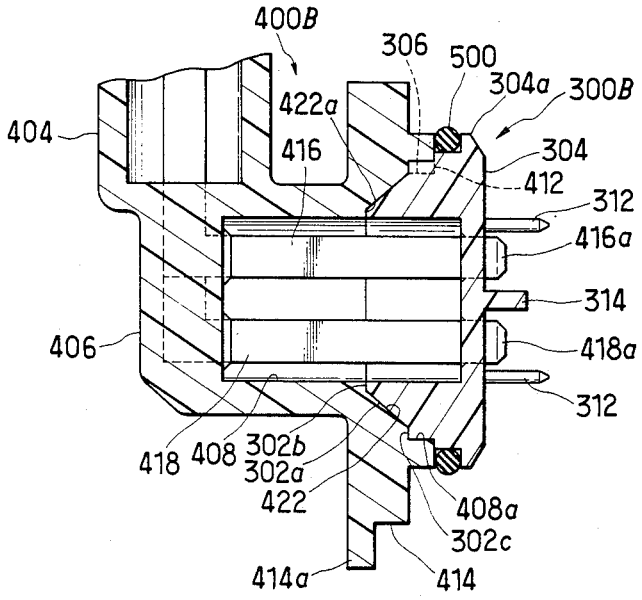

Referring to FIGS. 8 to 16 (B), particularly FIGS. 8, 9 and 10, there is shown a second embodiment 10B of the present invention, which is somewhat improved as compared with the afore-mentioned first embodiment 10A. Since the construction of the second embodiment 10B is similar to that of the first embodiment 10A, only the parts different from those of the first embodiment 10A are described in detail in the following.

That is, the bulb holder 200B, the core structure 300B and the base structure 400B are somewhat different in construction from those of the first embodiment 10A.

As is seen from FIG. 8, the foot portions 204 of the bulb holder 200B are each formed with a semitubular skirt **204*b* which has an arcuate cross section. Upon assembly of the bulb assembly (100+200B) and the base assembly (300B+400), the semitubular skirts 204*b* cover the supporting pins 312 of the core structure 300B, as is seen from FIG. 9. With these skirts, the ends of the horizontal plate portions 416*a* and 418*a* projected from the slits 308 and 310 of the core structure 300B are protected from foreign objects. Furthermore, in the second embodiment, two smaller lug portions 206 and a larger lug portion 206*b* are formed on the other end of the band portion 202, which support the bottom of the halogen bulb 102** upon assembly.

The core structure 300B is somewhat different from that of the first embodiment 10A. That is, as is best seen From FIGS. 10 and 15, the leading end of the collar portion 302 of the core structure 300B is tapered to form a frusto-conical outer surface **302*a*, leaving annular steps 302*b* and 302*c* at axially opposed ends of the frusto-conical surface 302*a* respectively. A rectangular projection 314 is formed on the circular plate portion 304 at a position between the rectangular slits 308 and 310. With this projection 314, the projected ends of the horizontal plate portions 416*a* and 418*a* from the slits 308 and 310 of the core structure 300B** are assuredly prevented from their short circuit.

The base structure 400B is also somewhat different from that of the first embodiment 10A. The hollow 408 of the hollow main portion 402 is formed with a frusto-conical inner surface 422 at the bottom of the enlarged entrance **408*a*, leaving annular steps 420 and 422*a* at axially opposed ends of the frusto-conical surface 422, as is seen from FIG. 8. It is to be noted that the above-mentioned frusto-conical outer and inner surfaces 302*a* and 422** are constructed to mate with each other.

Upon coupling of the core structure 300B and the base structure 400B, the frusto-conical surfaces **302*a* and 422 thereof intimately contact to each other. A supersonic welding is applied to the mutually contacted frusto-conical surfaces 302*a* and 422 to achieve bonding therebetween. During this supersonic welding, the two structures 300B and 400B are kept pressed against each other. Thus, the collar portion 302 of the core structure 300B is gradually but slightly moved into the enlarged entrance 408*a* of the hollow main portion 402 and stopped when the annular steps 302*b* and 302*c* of the collar portion 302 of the core structure 300B come into contact with the annular steps 422*a* and 420 of the hollow 408 of the base structure 400B as is understood from FIG. 16(B). Then, the supersonic wave application is stopped. It has been revealed that the lamp assembly 10B of the second embodiment surpasses the lamp assembly 10A** of the first embodiment in dimensional accuracy.

Referring to FIGS. 17 to 20, there is shown a third embodiment 10C of the present invention. Since the electric lamp assembly 10C of this third embodiment is similar in construction to that of the afore-mentioned first embodiment 10A, only the parts different from those of the first embodiment 10A are described in the following.

That is, in the third embodiment, the bulb unit 100C and the bulb holder 200C are somewhat different from those of the first embodiment 10A.

Figure 17:
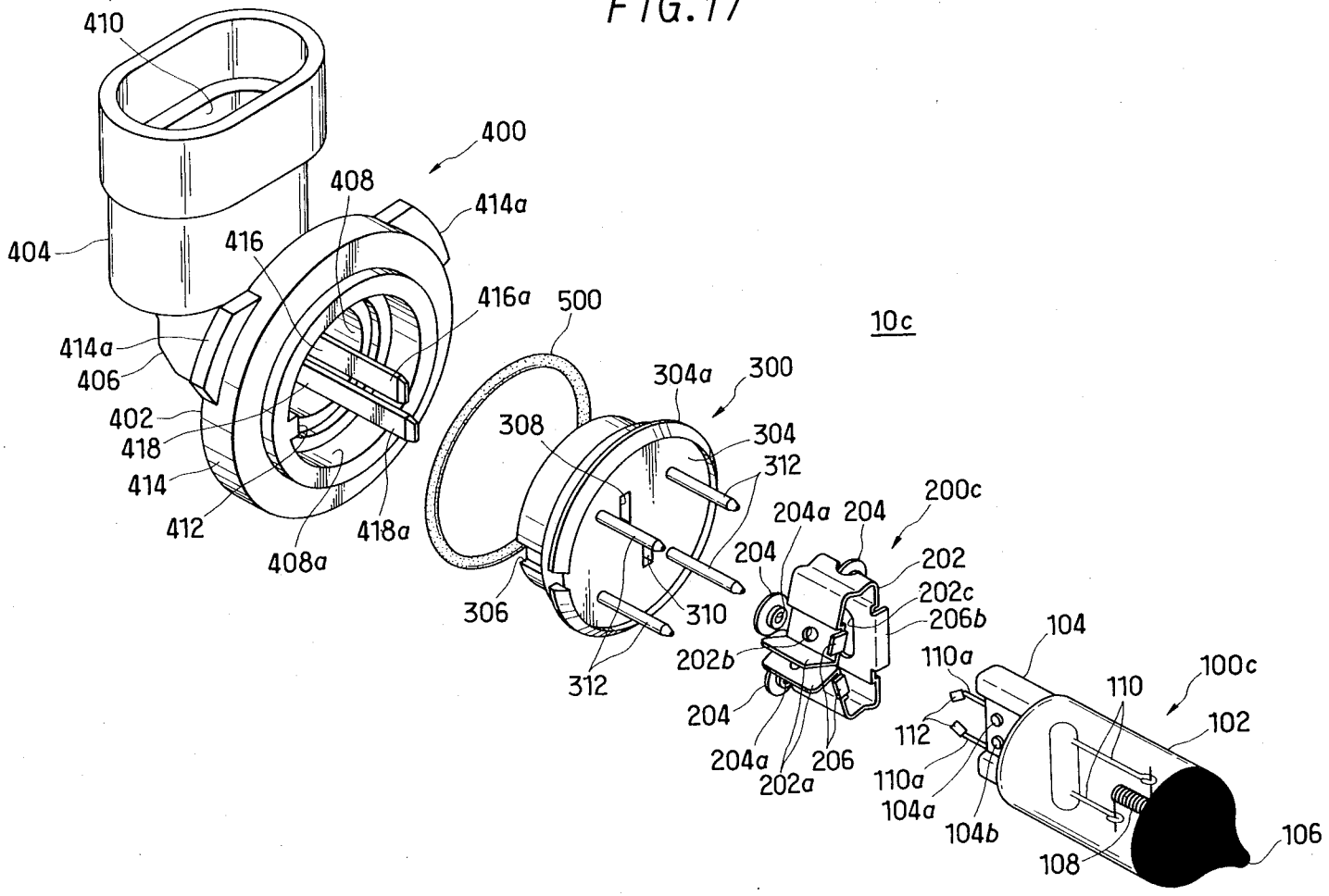
Figure 18:
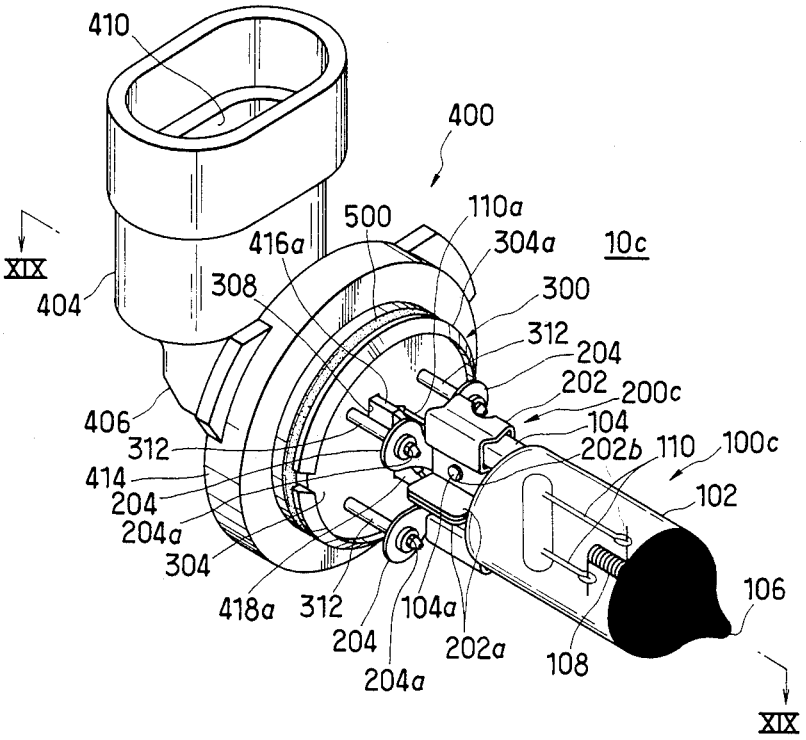
Figure 19:
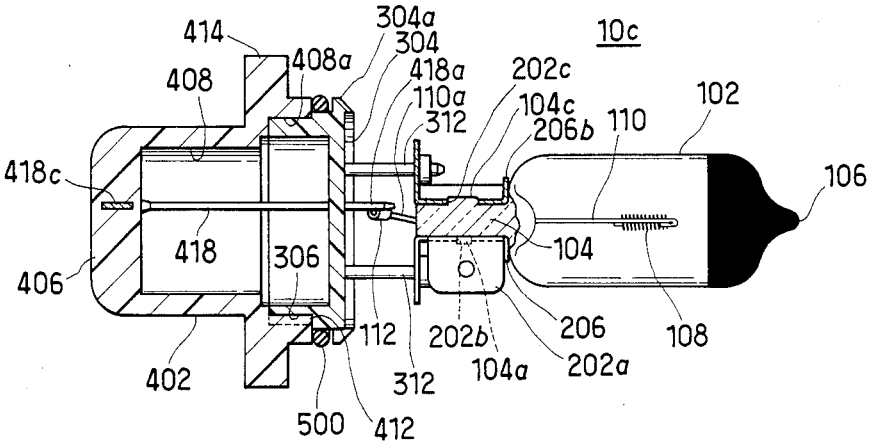
Figure 20:
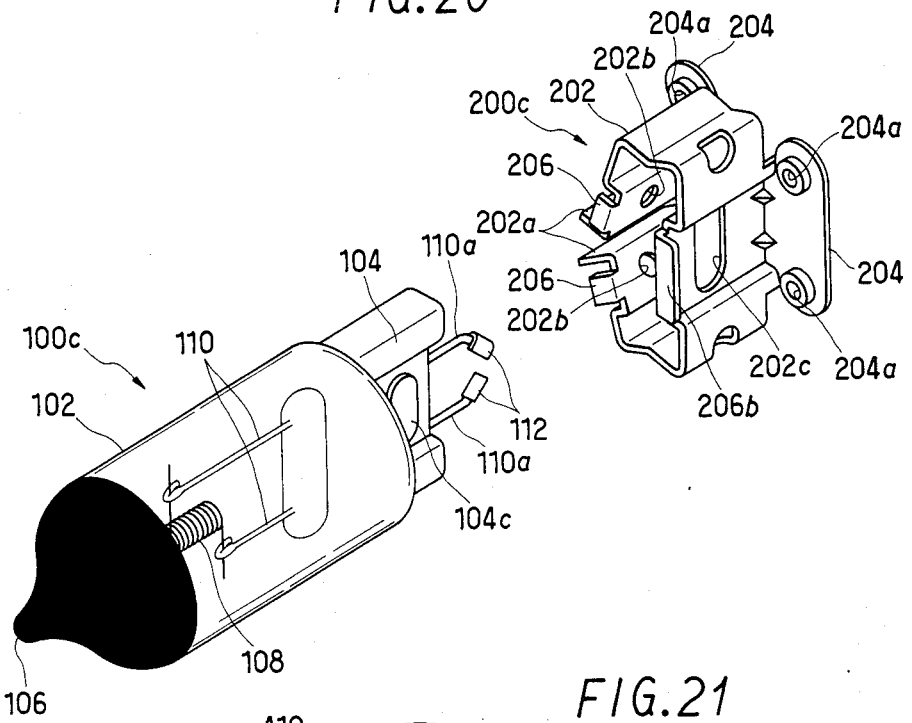

As is seen from FIGS. 17 and 20, the hermetic seal 104 of the bulb unit 100C is provided at one side thereof with two smaller circular projections **104*a* and 104*b* and at the other side thereof with a larger oval projection 1O4*c*. The exterior leads 110*a* extending from the hermetic seal 104 are each equipped with a piece of nickel ribon 112 of 0.1 to 0.15 mm in thickness folded double. It has been revealed that usage of the nickel ribbon improves the welding applied for securing the exterior leads 110*a* and the horizontal plate portions 416*a* and 418*a***.

The bulb holder 200C has at one side of the band portion 202 two smaller circular openings **202*b* and 202*b* (see FIG. 20) and at the other side of the band portion 202 a larger oval opening 202*c***.

Upon coupling of the bulb holder 200C and the bulb unit 100, the smaller projections **104*a* and 104*b* and the larger oval projection 104*c* of the hermetic seal 104 are respectively put in the smaller openings 202*b* and 202*b* and the larger oval opening 202*c* of the band portion 202. With this, positioning of the bulb unit 100C relative to the bulb holder 200C is improved as compared with the afore-mentioned first and second embodiments 10A and 10B**.

Figure 21:
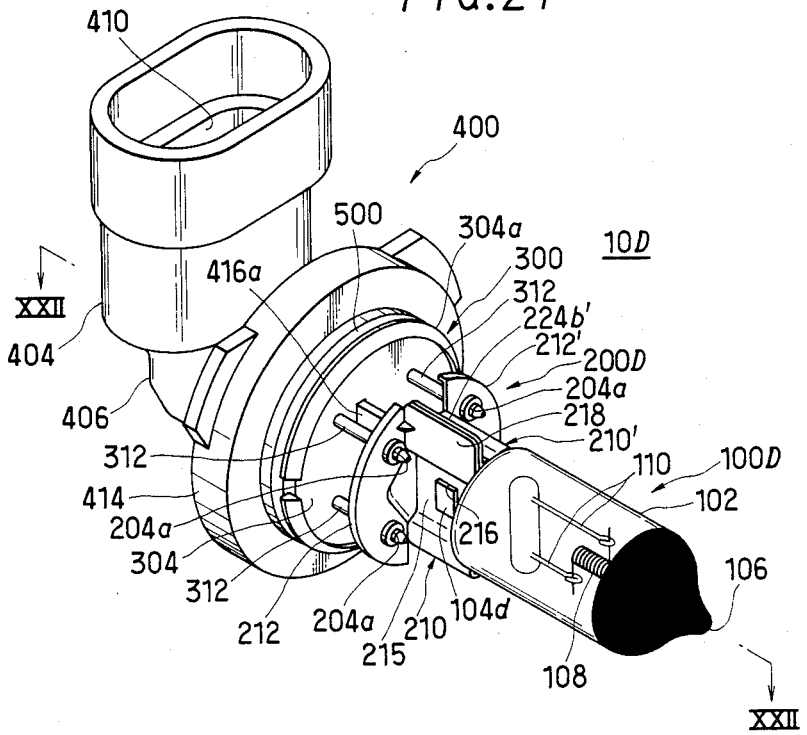
Figure 22:
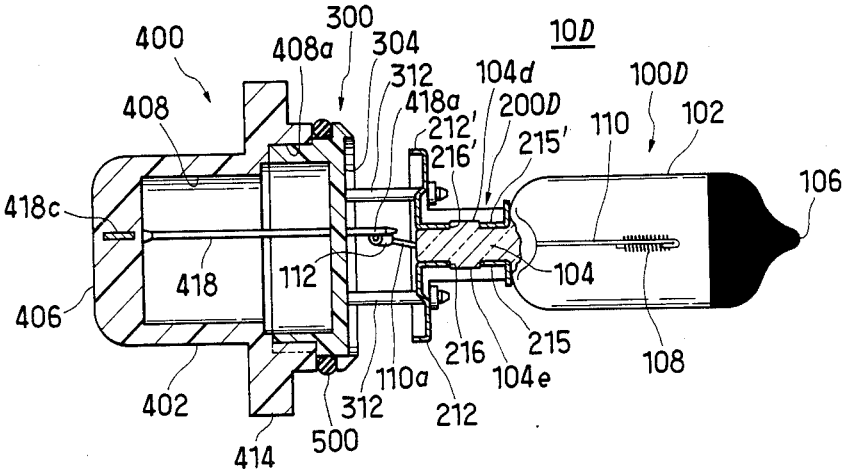
Figure 23:
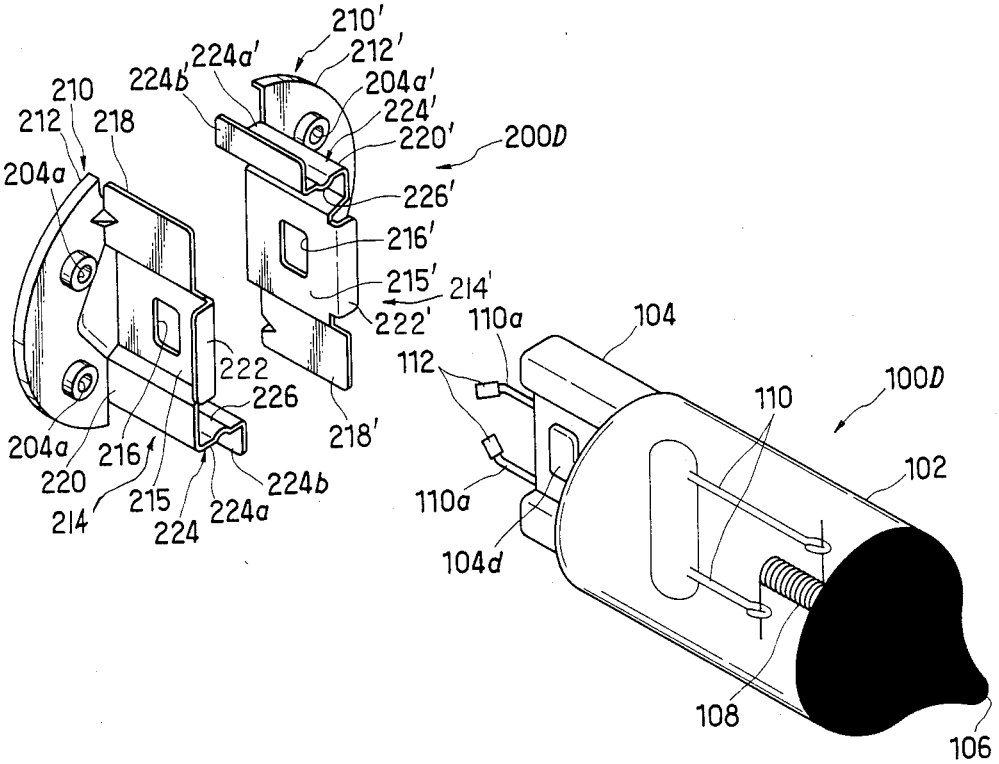

Referring to FIGS. 21 to 23, there is shown a fourth embodiment 10D of the present invention. Since the electric lamp assembly 10C of this fourth embodiment is also similar in construction to that of the aforementioned first embodiment 10A, only the parts different from those of the first embodiment 10A are described in the following.

That is, in the fourth embodiment, the bulb unit 100D and the bulb holder 200D are somewhat different from those of the first embodiment 100A.

As is best understood from FIG. 23, the hermetic seal 104 of the bulb unit 100D is provided at each side thereof with a rectangular projection **104*d* or 104*e*. The exterior leads 110*a* extending from the hermetic seal 104 are each equipped with a piece of nickel ribbon 112** folded double.

The bulb holder 200D comprises generally two identical halves 210 and 210' which are coupled to form a unit. Because of their equality in construction, only one of them (210) will be described. But, the parts of the other one are each denoted by adding a prime after the corresponding reference numeral.

Each half 210 comprises a semicircular base portion 212 and a rectangular stand portion 214 which are perpendicularly connected to each other. The base portion 210 is formed with two openings **204*a* each being defined by a small annular ring secured to the base portion. The openings 204*a* are those through which the supporting pins 312 of the core structure 300 pass. The rectangular stand portion 214 includes a depressed middle part 215 having a rectangular opening 216 formed therein, an upper part 218 extending upward from the middle part 215 and a lower part 220 extending downward from the middle part 215. The middle part 215 is formed with a lug 222 which, upon assembly, supports the bottom of the halogen bulb 102 of the bulb unit 100D. The lower part 220 has an extension 224 which has a generally L-shaped cross section which includes first and second sections 224*a* and 224*b*. As is understood from FIG. 23, the extension 224 protrudes toward a counterpart 218' of the other half 210'. A bead 226 is formed on the first section 224*a* of the extension 224**.

For coupling the bulb holder 200D and the bulb unit 100D, the two identical halves 210 and 210' are mutually turned at 180 degrees and respectively attached at the rectangular stand portions 214 and 214' thereof to both sides of the hermetic seal 104 of the bulb unit 100D having the rectangular projections **104*d* and 104*e* of the hermetic seal 104 snugly received in the rectangular openings 216 of the halves. With this, the part 218 and the second section 224*b* of one 210 of the halves are brought into contact with the second section 224b' and the part 218' of the other half 210', respectively. Then, the contacting portions are spotwelded. With this, the united bulb holder 200D is tightly mounted about the hermetic seal 104 of the bulb unit 100D. By the engagement between each projection 104*d* or 104*e* and each opening 216 or 216', the relative positioning between the bulb holder 200D and the bulb unit 100D** is assured.

Figure 24:
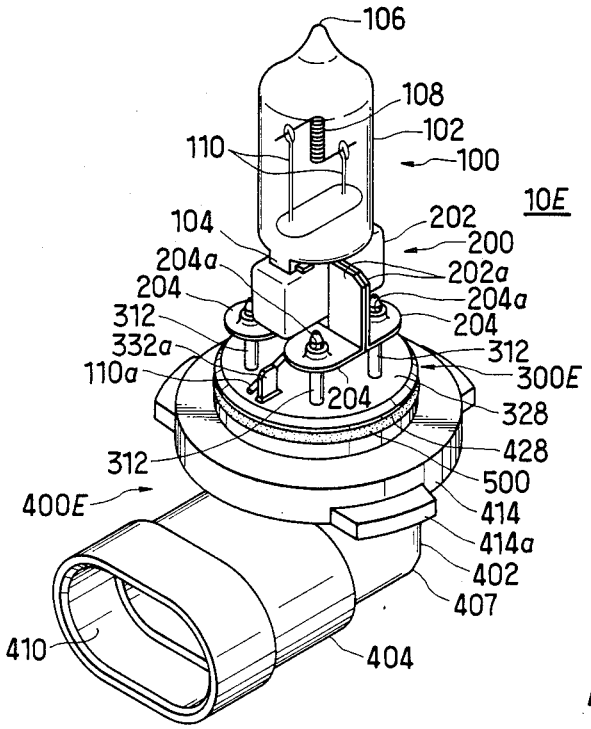
Figure 25:
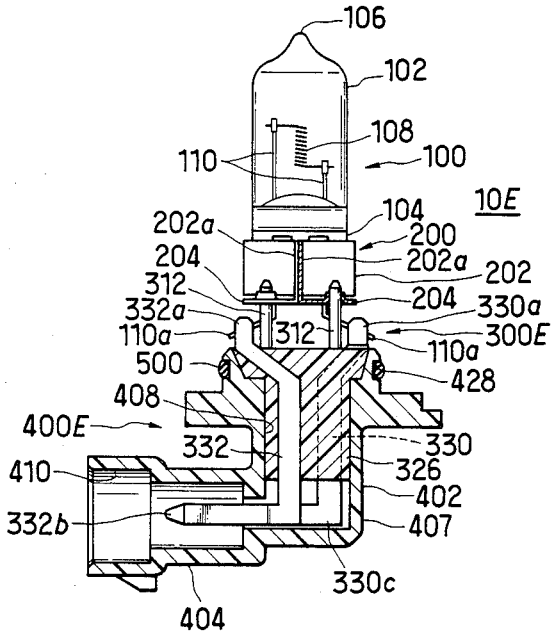
Figure 26:
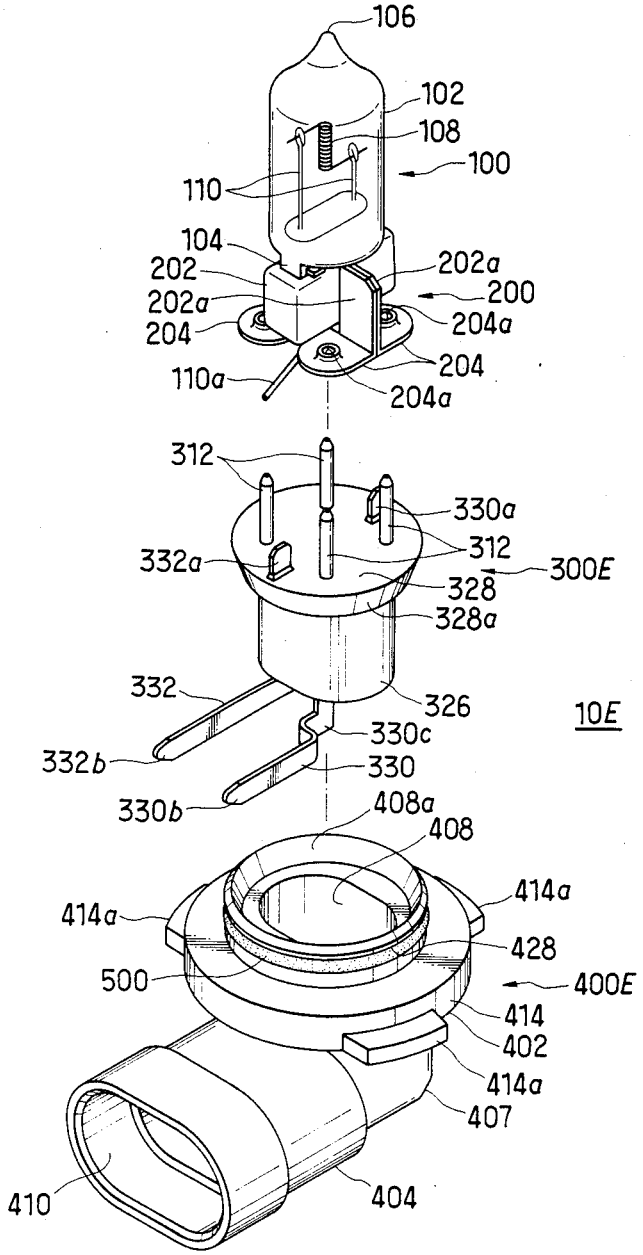

Referring to FIGS. 24 to 26, there is shown an electric lamp assembly 10E of a fifth embodiment of the present invention. As may be understood from FIG. 24, in this fifth embodiment, the bulb assembly (100+200) is substantially the same as that of the first embodiment 10A. That is, the core structure 300E and the base structure 400E of the fifth embodiment are somewhat different from those of the first embodiment 10A. Thus, only the core structure 300E and the base structure 400E will be described in the following.

The core structure 300E comprises a semicylindrical portion 326 of a generally oval cross section and a circular plate portion 328 which are of a monoblock construction of moulded plastics. The circular plate portion 328 is formed with a frusto-conical outer surface **328*a* which is tapered toward the semicylindrical portion 326, as shown. Four supporting pins 312 are embedded at their one end portions in the circular plate portion 328 and extend therefrom. Two generally L-shaped conducting plates 330 and 332 are embedded at their one arm portions in the core structure with the other arm portions 330*b* and 332*b* thereof extending radially outward from the axial rear end of the semicylindrical portion 326. As shown, the leading ends 330*a* and 330*b* of the one arm portions are projected outward from the circular plate portion 328 beside the supporting pins 312. For the purpose of providing the other arm portions 330*b* and 332*b* with a given distance therebetween, the conducting plate 330 is bent somewhat outward at 330*c***.

The base structure 400E has therein a through bore extending therealong and comprises a hollow main portion 402 and a hollow sub portion 404 which are connected at generally right angles with the interposition of a hollow joint portion 407 therebetween. The hollow 408 of the main portion 402 has an oval cross section to match the shape of the semicylindrical portion 326 of the core structure 300E. An annular flange portion 414 is integrally formed on the main portion 402, which has three spaced projections **414*a*. The leading end portion of the hollow main portion 402 is formed with an annular groove 428 for receiving therein a seal ring 500. The entrance of the hollow 408 is bounded by a frusto-conical surface 408*a* which matches with the frusto-conical surface 328*a* of the circular plate portion 328 of the core structure 300E**.

For coupling the core structure 300E and the base structure 400E together, the semicylindrical portion 326 of the core structure 300E is snugly put into the hollow 408 of the base structure 400E to such an extent that the frusto-conical surface **328*a* of the core structure 300E abuts on the frusto-conical inner surface 408*a* of the entrance of the base structure 400E. It is to be noted that the arm portions 330*b* and 332*b* of the conducting plates 330 and 332 can clear the hollow 408 by inclining the core structure 300E upon coupling. Then, a supersonic welding is applied to the coupled structures 300E and 400E to bond the same. With this, a base assembly (300E+400E)** is provided.

Then, the afore-mentioned bulb assembly (100+200) is put on the core structure 300E having the tips of the supporting pins 312 of the core structure received in the openings **204*a* of the foot portions 204 of the bulb holder 200. Then, a suitable welding is applied for achieving tight connection between the foot portions 204 and the pins 312, and then, the exterior leads 110*a* from the bulb unit 100 are welded to the slightly projected ends 330*a* and 332*a* of the conducting pates 330 and 332**.

With the above-mentioned assembling steps, the electric lamp assembly 10E as shown in FIG. 24 is provided.

Referring to FIGS. 27 to 30, there is shown an electric lamp assembly 10F of a sixth embodiment of the present invention. As is well understood from FIG. 28, in this sixth embodiment, the bulb assembly (100+200) is substantially the same as that of the first embodiment 10A, and the base structure is the same as that of the fifth embodiment 10E and thus designated by the same reference 400E. Thus, only the core structure 300F will be described in detail in the following.

The core structure 300F comprises a semicylindrical portion 326 of a generally oval cross section and a circular plate portion 328 which are of a monoblock moulded plastics. The circular plate portion 328 is formed with a frusto-conical outer surface **328*a*. Four small bores 334 are formed in the circular plate portion 328, and axially extending slits 336*a* and 336*b* are formed in the diametrically opposed portions of the core structure 400F. Four supporting pins 312 each having a knurled lower end 312*b* are pressed into the bores 334 of the circular plate portion 328, so that the pins 312 stand on the circular plate portion 328**.

Designated by numerals 330 and 332 are generally L-shaped conducting plates which are to be received in the slits **336*b* and 336*a*** upon assembly.

Coupling of the core structure 300F and the base structure 400E is made as follows.

First, the conducting plates 330 and 332 are put into the hollow 408 of the base structure with their one arm portions **330*a* and 332*a* extending outward. Then, the pin-mounted core structure 300F is snugly received in the hollow 408 having the arm portions 330*a* and 332*a* of the conducting plates 330 and 332 slidably received in the slits 336*b* and 336*a* respectively. Then, a suitable supersonic welding is applied for bonding the coupled structures, like in the case of the afore-mentioned fifth embodiment 10E. With this, a base assembly (300F+400E)** is provided.

Then, the bulb assembly (100+200) is fixed to the core structure 300F in the same manner as has been described in the section of the fifth embodiment 10E.

Figure 27:
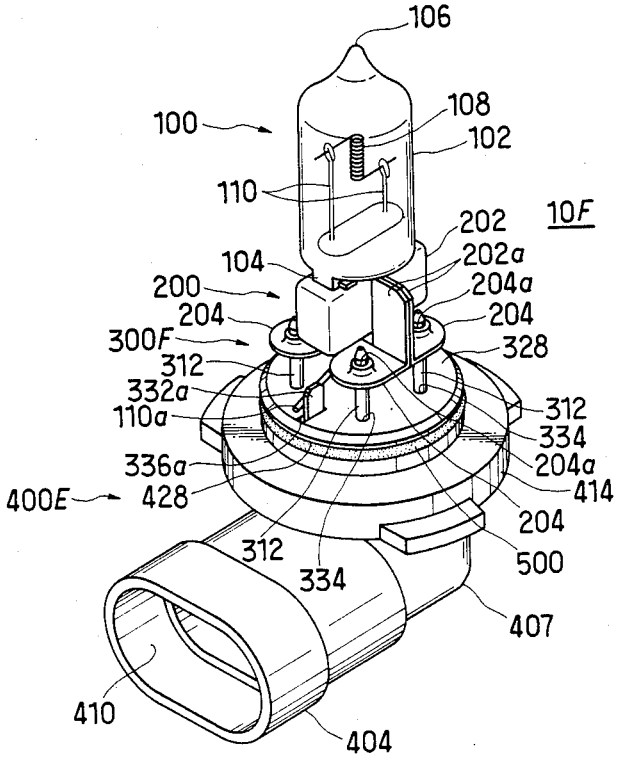
Figure 28:
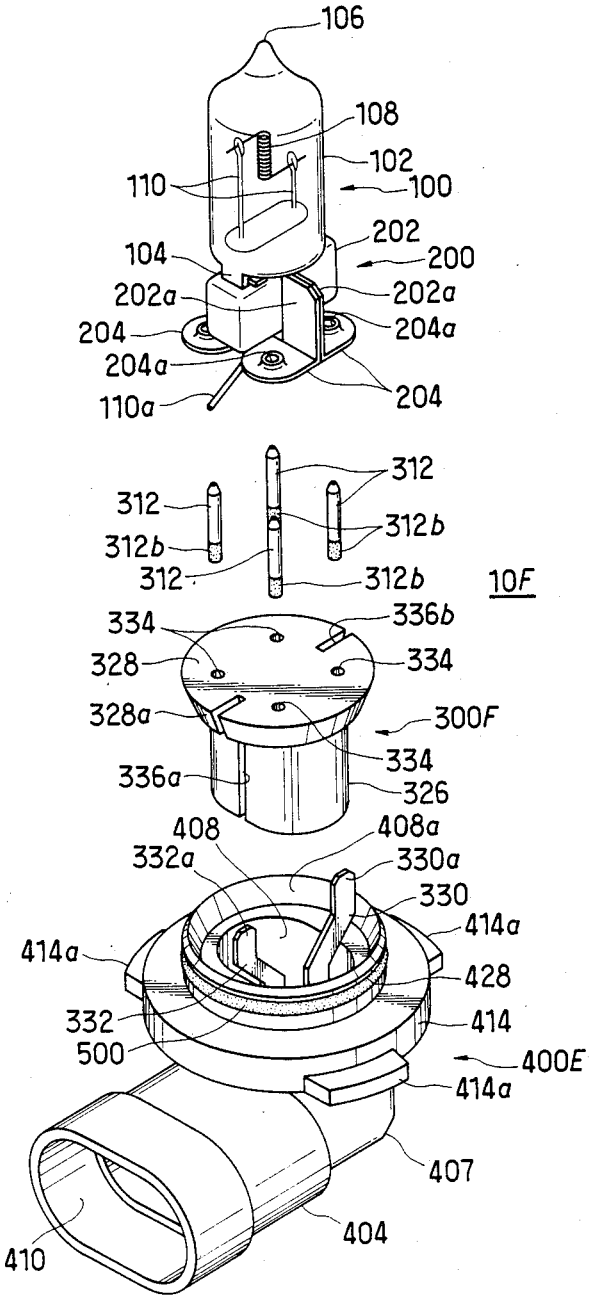
Figure 29:
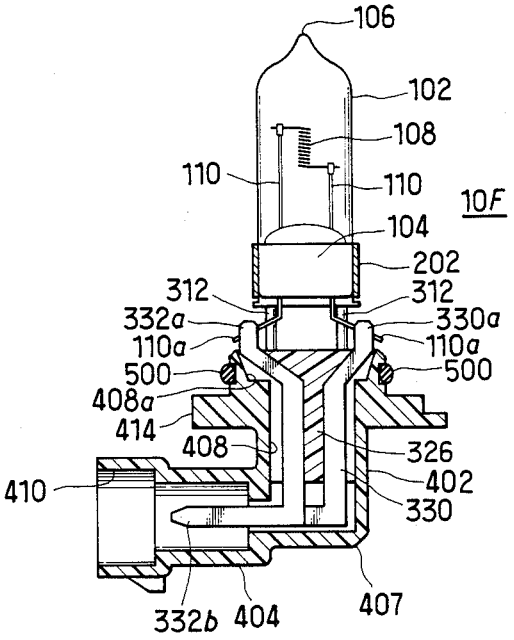
Figure 30:
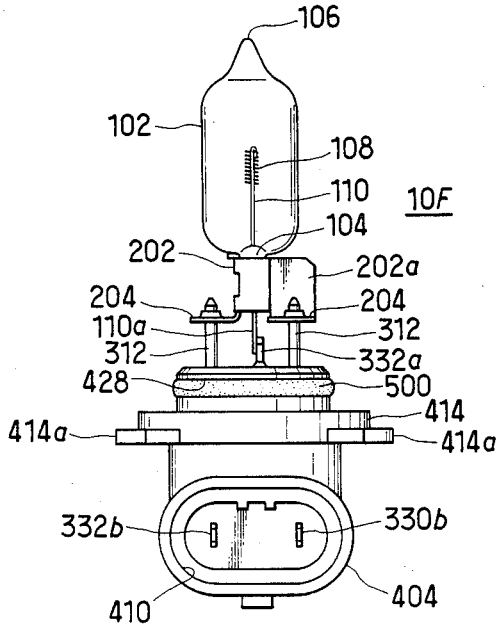
Figure 31:
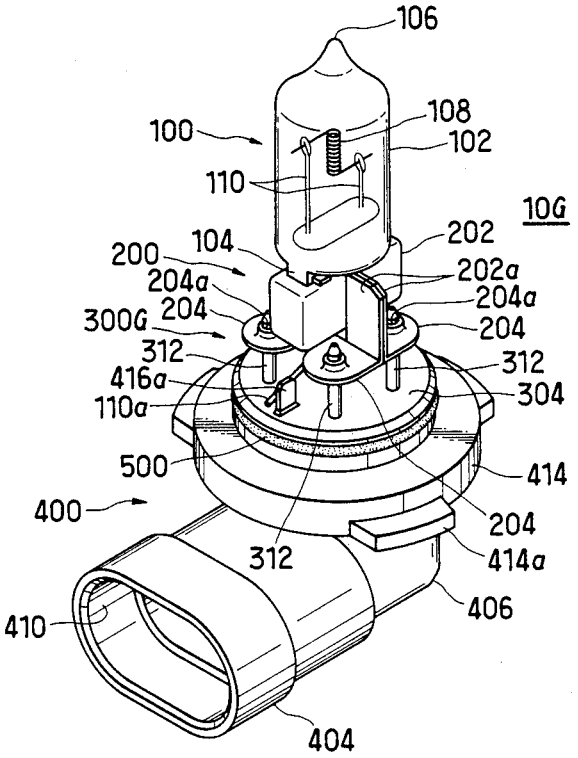
Figure 32:
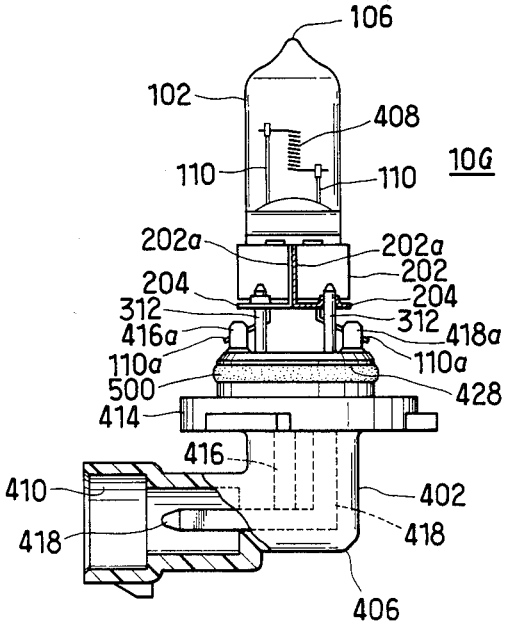
Figure 33:
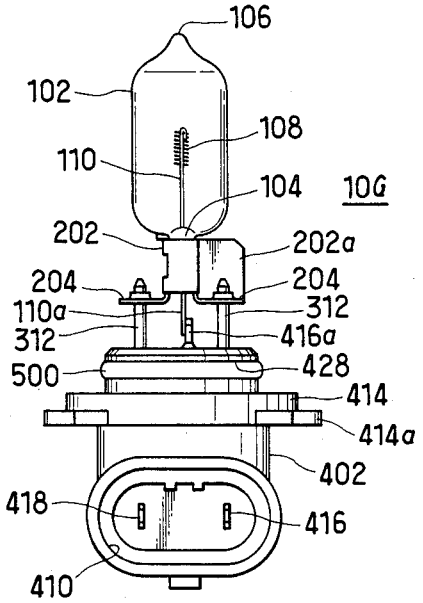

With the above-mentioned assembling steps, the electric lamp assembly 10F as shown in FIG. 27 is provided.

Referring to FIGS. 31 to 34, there is shown an electric lamp assembly 10G of a seventh embodiment of the present invention. As may be understood from FIGS. 31 and 32, the electric lamp assembly 10G of the seventh embodiment is substantially the same as that of the first embodiment 10A except the arrangement of the L-shaped conducting plates 416 and 418. That is, in the seventh embodiment 10G, the tips **416*a* and 418*a* of the conducting plates which are slightly projected from the circular plate portion 304 of the core structure 300 are positioned near the periphery of the circular plate portion 304, that is, outside of the supporting pins 312. This arrangement will be well understood from FIG. 34. With this arrangement, the work for welding the exterior lead wires 110***a* from the bulb unit 100 to the tips 416*a* and 418*a* is very facilitated as compared with the case of the first embodiment 10A.

Figure 35:
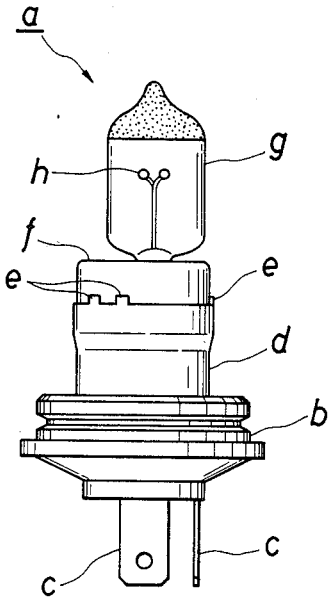
FIG. 35 (PRIOR ART)
Figure 34:
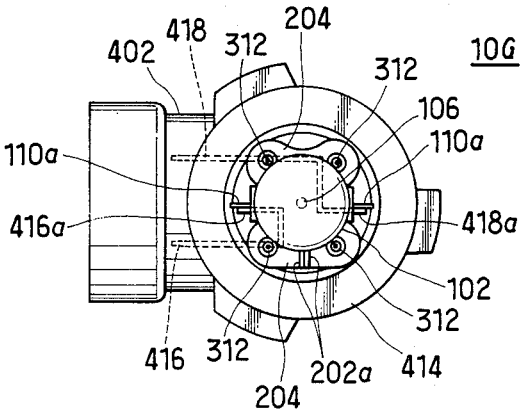

As will be understood from the foregoing description, the electric lamp assembly of the present invention can have the following advantages which the aforementioned conventional assembly of FIG. 35 fails to have.

Because the leading ends of the lead wires from the bulb and those of the terminal members extending from the base structure, which are to be welded, are exposed to the outside of the electric lamp assembly, welding of them is easily achieved. That is, unlike the case of the afore-mentioned conventional electric lamp assembly of FIG. 35, the manner of the wedling is viewed.

Because of presence of the positioning means which comprises the axially extending groove of the core structure and the axially extending ridge in the bore of the base structure, the position setting of the core structure, viz., the position setting of the bulb unit relative to the base structure is easily achieved.

Because of the "hollow" construction of the base structure, it is possible to reduce not only the weight of the electric lamp assembly but also the amount of plastic materials used for producing the same. Thus, the electric lamp assembly of the invention is applicable to various industrial field.

What is claimed is:

1. An electric lamp assembly comprising:
a bulb unit with a filament;
a bulb holder tightly holding said bulb unit,
said bulb holder comprising:
a separate rectangularly looped band portion;
foot portions radially outwardly projected from one end of said band portion
and having at least three openings formed therein;
a core structure of molded plastics;
parallel supporting pins which are arranged to adjust the distance between said filament and said core structure, each supporting pin having one end tightly embedded in said core structure and another end tightly received and secured to one of said openings of said bulb holder;
a base structure of molded plastics constructed so as to be essentially hollow and having an entrance in which said core structure is snugly received;
stopper means formed in each of said core and base structures for preventing relative rotation therebetween; and
elongate conducting members extending through the hollow of said base structure, each member having one end connected to said filament through a lead wire and another end placed in a given portion of said hollow;
lug portions radially outwardly projected from the other end of said band portion, said band portion being sized and constructed to grip a rectangular hermatic seal portion of said bulb unit, said foot portions being connected to said supporting pins by welding.

2. An electric lamp assembly as claimed in claim 1, further comprising means for forming an annular groove adapted to receive sealing means when said core structure and said base structure are coupled with one another.

3. An electric lamp assembly as claimed in claim 2, wherein said sealing means comprises an o-ring.

4. An electric lamp assembly as claimed in claim 2, wherein said foot portions are formed with respective openings into which tips of the supporting pins are received respectively.

5. An electric lamp assembly as claimed in claim 4, further comprising an annular ring member secured to each of the foot portions, coaxially with the opening of the foot portion.

6. An electric lamp assembly as claimed in claim 2, in which said band portion has opposed flat ends which are welded upon mounting to said rectangular hermetic seal portion of the bulb unit.

7. An electric lamp assembly as claimed in claim 6, further comprising positioning means for assuring positioning between said bulb holder and said bulb unit.

8. An electric lamp assembly as claimed in claim 7, wherein said positioning means comprises:
projections formed on said hermetic seal of said bulb unit; and
openings formed in said band portion of said bulb holder, said projections being received in said openings upon coupling of said bulb holder and said bulb unit.

9. An electric lamp assembly as claimed in claim 8, wherein said bulb holder comprises two identical halves which are coupled to form a unit.

10. An electric lamp assembly as claimed in claim 2, wherein said base structure comprises:
a hollow main portion; and
a hollow sub portion perpendicularly connected to said hollow main portion.

11. An electric lamp assembly as claimed in claim 10, wherein said base structure further comprises a solid joint portion integrally disposed between said hollow main portion and said hollow sub portion thereby dividing said hollow into first and second hollow portions which are respectively defined in said hollow main portion and said hollow sub portion.

12. An electric lamp assembly as claimed in claim 11, wherein each of said elongate conducting members has a generally L-shaped configuration including mutually intersecting first and second elongate sections, and is tightly held by said solid joint portion with said first and second elongate sections passing through said first and second hollow portions respectively.

13. An electric lamp assembly as claimed in claim 12, wherein said elongate conducting members have respective middle portions which are bent away from each other to provide the second elongate sections of the elongate conducting members with a given distance therebetween.

14. An electric lamp assembly as claimed in claim 12, wherein said entrance of said base structure is defined by a part of said first hollow and snugly receives therein a portion of said core structure.

15. An electric lamp assembly as claimed in claim 14, wherein said core structure comprises:
a collar portion snugly received in said entrance of said base structure; and
a circular plate portion coaxially connected to said collar portion.

16. An electric lamp assembly as claimed in claim 15, wherein said collar portion of said core structure is welded to an inner surface of said entrance of the base structure.

17. An electric lamp assembly as claimed in claim 16, wherein said circular plate portion has openings for receiving therein leading ends of said first elongate sections of the L-shaped conducting members.

18. An electric lamp assembly as claimed in claim 17, wherein said stopper means comprises positioning means for assuring positioning between said core structure and said base structure upon coupling of said core and base structure.

19. An electric lamp assembly as claimed in claim 18, wherein said positioning means comprises:

an axially extending groove formed in an outer surface of said collar portion of said core structure; and an axially extending key projection formed on the inner surface of said entrance of the base structure, said key projection being received in said groove upon coupling of said core structure and said base structure.

20. An electric lamp assembly as claimed in claim 19, wherein said positioning means further comprises:

a frusto-conical outer surface defined by a leading end of said collar portion of said core structure; and a frusto-conical inner surface defined by said entrance of said base structure, the frusto-conical outer and inner surfaces being intimately mated upon coupling of said core structure and said base structure.

21. An electric lamp assembly as claimed in claim 20, further comprising a lug which is formed on said circular plate portion at a position between said openings formed in said circular plate portion.

22. An electric lamp assembly as claimed in claim 10, in which the hollow of said base structure is a through bore which comprises a first hollow portion defined in said main portion and a second hollow portion defined in said sub portion.

23. An electric lamp assembly as claimed in claim 22, wherein said core structure comprises:

a cylindrical solid portion received in said first hollow portion of said base structure;

a circular plate portion integrally connected to said cylindrical solid portion and received in the entrance of said first hollow portion upon coupling of said core structure and the base structure.

24. An electric lamp assembly as claimed in claim 23, wherein each of said elongate conducting members has a generally L-shaped configulation including mutually intersecting first and second elongate sections, and is held by said core structure with said first and second elongate sections passing through said first and second hollow portions of the base structure respectively.

25. An electric lamp assembly as claimed in claim 24, wherein said elongate conducting members have respective middle portions which are bent away from each other to provide the second elongate sections of the elongate conducting members with a given distance therebetween.

26. An electric lamp assembly as claimed in claim 24, wherein said circular plate portion of said core structure is welded to an inner surface of said entrance of said first hollow portion of the base structure.

27. An electric lamp assembly as claimed in claim 26, wherein said first elongate sections of said elongate conducting members are embedded in said cylindrical solid portion of the core structure.

28. An electric lamp assembly as claimed in claim 27, wherein said circular plate portion of the core structure has openings for receiving therein leading ends of said first elongate sections of the L-shaped conducting members.

29. An electric lamp assembly as claimed in claim 26, wherein said first elongate sections of the conducting members are received in axially extending slits which are formed in diametrically opposed portions of said cylindrical solid portion of the core structure.

30. An electric lamp assembly as claimed in claim 25, wherein said cylindrical solid portion of said core structure has an oval cross section and in which said first hollow portion of said base structure has also an oval cross section matching with that of said cylindrical solid portion.

31. An electric lamp assembly as claimed in claim 30, wherein said circular plate portion of the core structure has a frusto-conical outer surface and in which said entrance of said first hollow portion has a frusto-conical inner surface matching with that of said circular plate portion, the frusto-conical outer and inner surfaces being intimately mated upon coupling of said core structure and said base structure.

32. An electric lamp assembly as claimed in claim 31, wherein said frusto-conical outer and inner surfaces are welded to each other.

* * * * *